United States Patent [19]

Tölle et al.

[11] Patent Number: 4,997,221

[45] Date of Patent: Mar. 5, 1991

[54] DOOR FASTENER FOR MOTOR VEHICLE DOORS

[75] Inventors: Karl-Heinz Tölle, Wuppertal; Willi Steckel, Remscheid, both of Fed. Rep. of Germany

[73] Assignee: Ed. Scharwächter GmbH & Co. KG.

[21] Appl. No.: 472,074

[22] Filed: Jan. 30, 1990

[30] Foreign Application Priority Data

Jan. 30, 1989 [DE] Fed. Rep. of Germany ..... 3902645

[51] Int. Cl.[5] ..... E05C 17/20

[52] U.S. Cl. ..... 292/275; 292/DIG. 57; 16/86 C; 16/DIG. 17

[58] Field of Search ..... 292/275, 278, 272, 193, 292/DIG. 57; 16/86 C, 91, DIG. 17

[56] References Cited

U.S. PATENT DOCUMENTS 804,228 11/1905 Hunt ..... 292/193 X
2,476,182 7/1949 Davidson ..... 16/86 C
2,693,616 11/1954 Cromwell et al. ..... 292/275 X
3,602,150 8/1971 Frost ..... 16/91 X

*Primary Examiner*—Richard E. Moore
*Attorney, Agent, or Firm*—Toren, McGeady & Associates

[57] ABSTRACT

In a door fastener for motor vehicle doors, whose rigid door holding bar, which is fixed at a door arrangement part, penetrates a holder housing in the other door arrangement part and is supported on the one hand against a rigidly supported abutment roller and is acted upon by means of a loading roller which is supported on the free loading arm of a torsion bar spring supported in the holder housing, the two rollers are equipped on both sides with a lubricant reservoir, which is accommodated in caps which are clipped on on the front sides of the rollers and is sealed relative to the respective bearing axis of the roller by means of sealing lips constructed at the caps.

14 Claims, 5 Drawing Sheets

DOOR FASTENER FOR MOTOR VEHICLE DOORS

BACKGROUND OF THE INVENTION

The invention is directed to a door fastener for motor vehicle doors comprising a door holding bar, which is supported at a door arrangement part, door or door post, and a holder which is fastened at another door arrangement part and is formed from a sheet metal blank which is shaped into a U-shaped housing. A torsion bar spring is supported in the holder via a shaft part and an abutment arm. In addition, an abutment roller is supported in the holder so as to be rotatable around a stationary axis. Furthermore, a loading roller is supported on a free loading arm of the torsion bar spring, and, finally, the two rollers cooperate with the oppositely located narrow sides of the door holding bar formed by means of a flat material blank.

In known door fasteners of this type, the abutment roller and the loading roller are supported on the fixed axis in the holder housing, on the one hand, and on the loading arm of the torsion bar spring, on the other hand, accompanied by the use of a thin layer of permanent lubricant in each instance. Such a support and lubrication results in the problem that the rollers tend to jam prematurely at the respective axis under the influence of environmental conditions, particularly by means of dust and condensation water precipitation, but also because of the consequences of long-term operation. Jamming is chiefly the result of the fact that the rollers often only execute a partial rotation and in so doing are also acted upon at constantly recurring points on their bearing circumference by very high loads resulting from the passage of the holding catches of the door holding bar. However, in door fasteners of the type in question, a roller which is not rotatable relative to its bearing axis or a roller which has become rotatable only with difficulty results in the roller grinding along the narrow side of the door holding bar assigned to it, so that a particularly loud and therefore highly undesirable noise results precisely in door fasteners because of the resonating effect caused by the door body. The use of a maintenance-free bearing via bushings or sleeves comprising maintenance-free bearing material is likewise faced by the problem of a recurring local high loading of the bearing at the same place on the bearing circumference in rollers which frequently execute only partial rotations. In many cases cost is also a factor in these types of bearings.

SUMMARY OF THE INVENTION

Therefore, it is an object of the present invention to provide an improved door fastener of the above-mentioned type so that a permanent absence of noise and an easy rotatability of the loading roller as well a the abutment roller is ensured. It is a further object to accomplish this by using means which are simply constructed and easy to assemble, and to rule out any risk of damage to the rollers or the parts of the door fastener adjacent to or cooperating with the latter.

Pursuant to this object, and others which will become apparent hereafter, one aspect of the present invention resides in assigning outwardly sealed lubricant reservoirs to the two rollers (abutment roller and loading roller) in the area of their two front sides, in each instance. A permanent lubrication of the rollers and accordingly their permanent easy rotatability is accordingly ensured with only a low production and assembly cost, so that jamming of the roller on its bearing axis and accordingly grinding of the roller at the narrow side of the door holding bar assigned to it, which leads to noise in the door fastener, is avoided.

A reliable and permanent accommodation of the lubricant reservoir which, in particular, is insensitive to a great extent to heating during the enamel baking of the car body. Simultaneously, a protection against damage is also achieved in that the lubricant reservoirs are accommodated in caps, which are placed on the front sides of the rollers and held at a distance from the end faces of the rollers at least in some areas, and provided with sealing lips.

A particularly simple construction and assembly of the caps receiving the lubricant reservoir is achieved in a preferred embodiment in that the caps defining the lubricant reservoirs are constructed in a substantially pot-shaped manner and held at the rollers by means of a clamping fastening in the area of their front sides and provided with sealing lips contacting the bearing axis of the roller.

In another embodiment of the invention it is also provided in particular that circumferentially extending edge beads, which are directed toward the middle of the roller, are provided at the inner circumferential area of the circumferential walls of the caps. Corresponding circumferentially extending receiving grooves which are asymmetrically V-shaped in cross section are assigned to the edge beads at axial projections of the rollers. The edge beads of the caps and the receiving grooves comprise support shoulders which are inclined from the outside to the inside in each instance and incline downward toward the center of the roller.

Preferably, the caps receiving the lubricant reservoirs are produced from a plastics material of limited elasticity and clipped onto the axial projections of the rollers. For this purpose the edge beads of the caps are provided with sliding surfaces which are arranged at asymmetrically acute angles relative to the support shoulders e.g. in such a way that the angle of inclination (60°) of the support shoulder surfaces relative to the vertical line is greater than the angle of inclination (30°) of the sliding surfaces (30°). In connection therewith, the end faces of the axial projections of the rollers in the area adjacent to the receiving grooves are equipped with a diagonal surface directed in the same direction as the sliding surfaces of the edge beads of the caps, the inclination of the diagonal surface relative to the vertical line being the sam magnitude as the inclination of the sliding surfaces of the edge beads of the caps.

In order to construct the lubricant reservoirs defined by the caps so as to be as large and permanently stable as possible with respect to form, it is further provided that the support webs be arranged at a distance from one another in the circumferential direction of the rollers and so as to be symmetrical relative to one another with respect to the roller axis. Additionally, the sealing lips contacting the respective bearing axis are constructed so as to be cantilevered proceeding from the support webs. The support webs serve to stabilize the hollow space required for accommodating the lubricant reservoir on the one hand and simultaneously also for maintaining the pretensioning of the caps required for a long-term secure clamping hold at the axially directed projections of the rollers on the other hand. In addition, particularly in order to prevent mechanical damage to the caps, the front sides of the caps are constructed as diagonal surfaces rising at the outside toward the roller axis, wherein the slope of these diagonal surfaces is preferably approximately equal to the height of the support webs. Additionally, a special securing of the clamping hold of the caps at the rollers is also achieved by means of this.

In order to protect the caps against mechanical damage, particularly their circumferential surfaces, it is further provided that the two rollers comprise radially directed guide rings on both sides of their running surfaces assigned to the door holding bar and that the height of at least one of these guide rings, at least of the abutment roller, is slightly larger than the outer circumference of the caps.

In a further embodiment of the invention it is provided, in addition, that the running surface of the loading roller assigned to the door holding bar is curved in a barrel-shaped manner.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
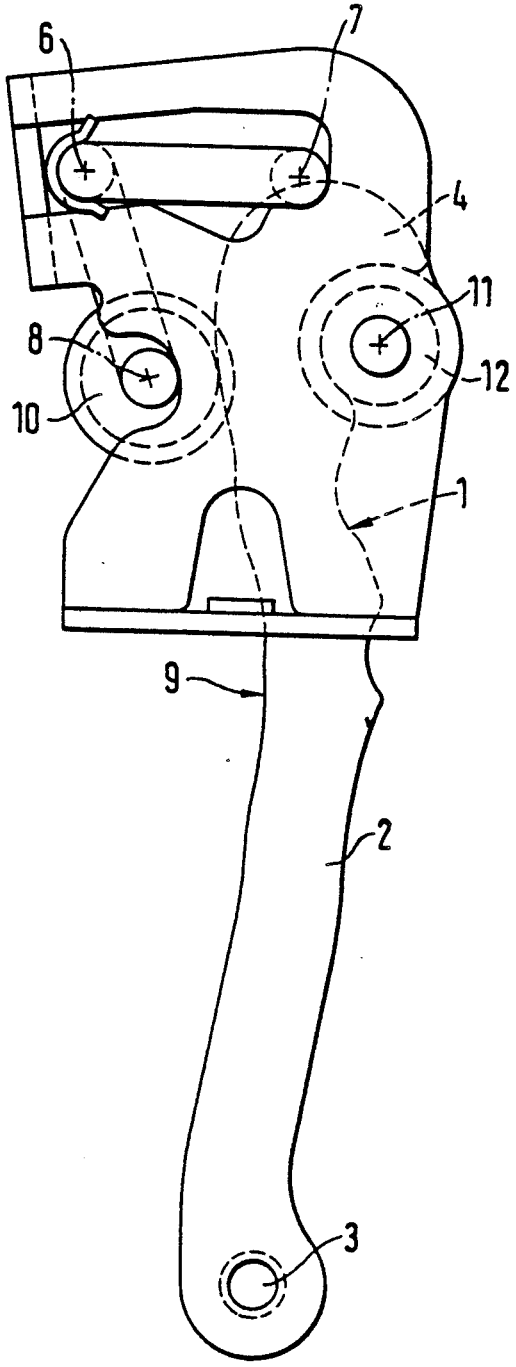
FIG. 1 shows a side view of a door fastener, according to the invention.

The door fastener shown in FIG. 1 substantially comprises a door holding bar 2 which is formed of a flat material blank and is provided on one side with braking and catching recesses 1 and is supported in a bearing block, not shown in more detail in the drawing, at one of the door arrangement parts, the door or the door post so as to be swivelable around an axis 3. The door holding bar 2 comprises, in addition, an opening end stop 4 for the door. The door holding bar 2 cooperates with a holder housing 5 which is formed from a sheet metal material and fixed at the other door arrangement part, a torsion bar spring being supported in the holder housing 5 via its shaft 6 and a support or abutment arm 7. At its free loading arm 8, the torsion bar spring carries a loading roller 10 acting on the back 9 of the door holding bar 2. An abutment roller 12, which is supported in the holder housing 5 so as to be rotatable around a stationary axis 11, cooperates with the narrow side of the door holding bar comprising the braking and catching recesses 1 and the opening end stop. A lubricant reservoir is assigned to the two rollers (loading roller 10 and abutment roller 12) of the door fastener at both sides, which lubricant reservoir is accommodated in a cap 13 overlapping the front side of the roller.

In the shown embodiment, the caps 13 comprise a plastics material and are fastened in a clamping manner at axial projections 14 constructed at the front sides of the rollers 10 and 12, respectively. The rollers 10 and 12 comprise, in the area of their front sides, circumferential grooves 15 in the transition to the axial projections 14, which circumferential grooves 15 are shaped in an asymmetrically V-shaped manner and whose external groove surface 16 forms a support shoulder and is adjusted at a angle of approximately 60° relative to the vertical line. The caps 13 are constructed in a substantially pot-shaped manner and comprise circumferentially extending edge beads 19 at their circumferential walls 17, which edge beads 19 face inward toward the roller axis 18 and in turn comprise support surfaces forming support shoulders 20 adjusted at an angle of approximately 60° relative to the vertical line.

The edge beads 19 comprise sliding surfaces 21 adjoining the support shoulders 20, which sliding surfaces 21 are inclined in the same direction and adjusted at an angle of approximately 30° relative to the vertical line. Corresponding sliding surfaces 22 at the front sides 23 of the axially directed projections 14 of the rollers 10 and 12, respectively, are assigned to the sliding surfaces 21.

The caps 13, which can be clipped on, are held at the axial projections 14 in both the radial and axial directions accompanied by pretensioning in each instance via the support shoulders 16/20. The caps 13 comprise support webs 25 which are arranged at a distance radially relative to the bearing bore hole 24 of the rollers 10 and !2, respectively, and contact the front sides 23 of the axial projections !4 and serve, on the one hand, to stabilize the hollow space 26 required for accommodating the lubricant reservoir and, on the other hand, to maintain the radially and axially directed pretensioning with which the support shoulders 20 of the caps 13 contact the support shoulders 16 of the axially directed projections 14. The support webs 25 are arranged in the circumferential direction of the rollers 10 and 12, respectively, at a distance 27 relative to one another and symmetrically with reference to the bearing axis of the rollers 10 and 12, respectively.

The lubricant reservoir is sealed by means of radially directed sealing lips 28 toward the respective bearing axis of the rollers 10 and 12, respectively, wherein the sealing lips 28 are constructed so as to be circumferentially extending and so as to cantilever toward the bearing axis proceeding from the support webs 25. As can be seen particularly from the view in FIG. 3, the abutment roller 12 comprises a running surface 29 which is curved in a barrel-shaped manner, while the loading roller 10 shown in FIG. 2 comprises a cylindrical running surface 30.

Figure 2:
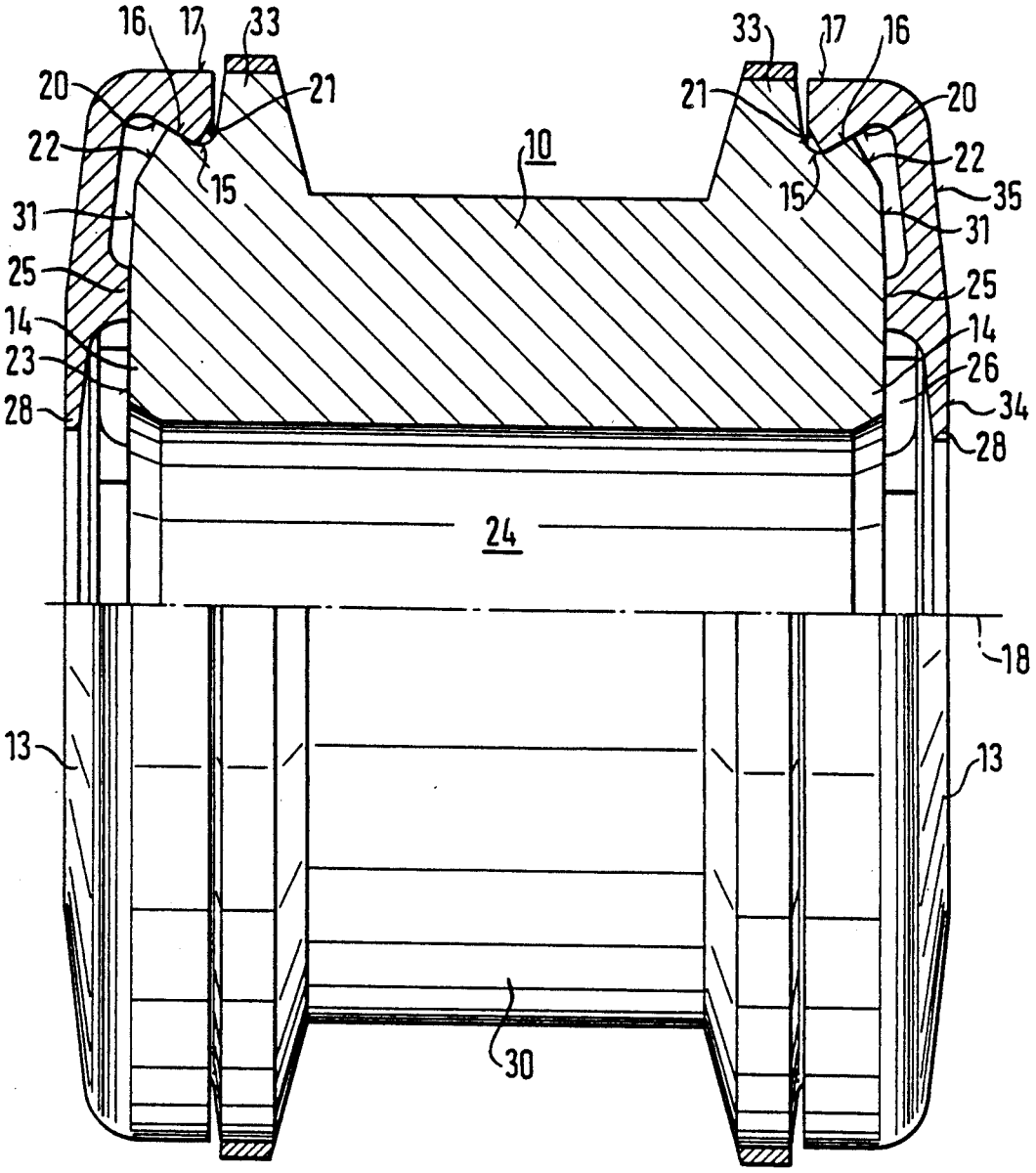
FIG. 2 shows a partial section through the loading roller of a door fastener according to FIG. 1.
Figure 3:
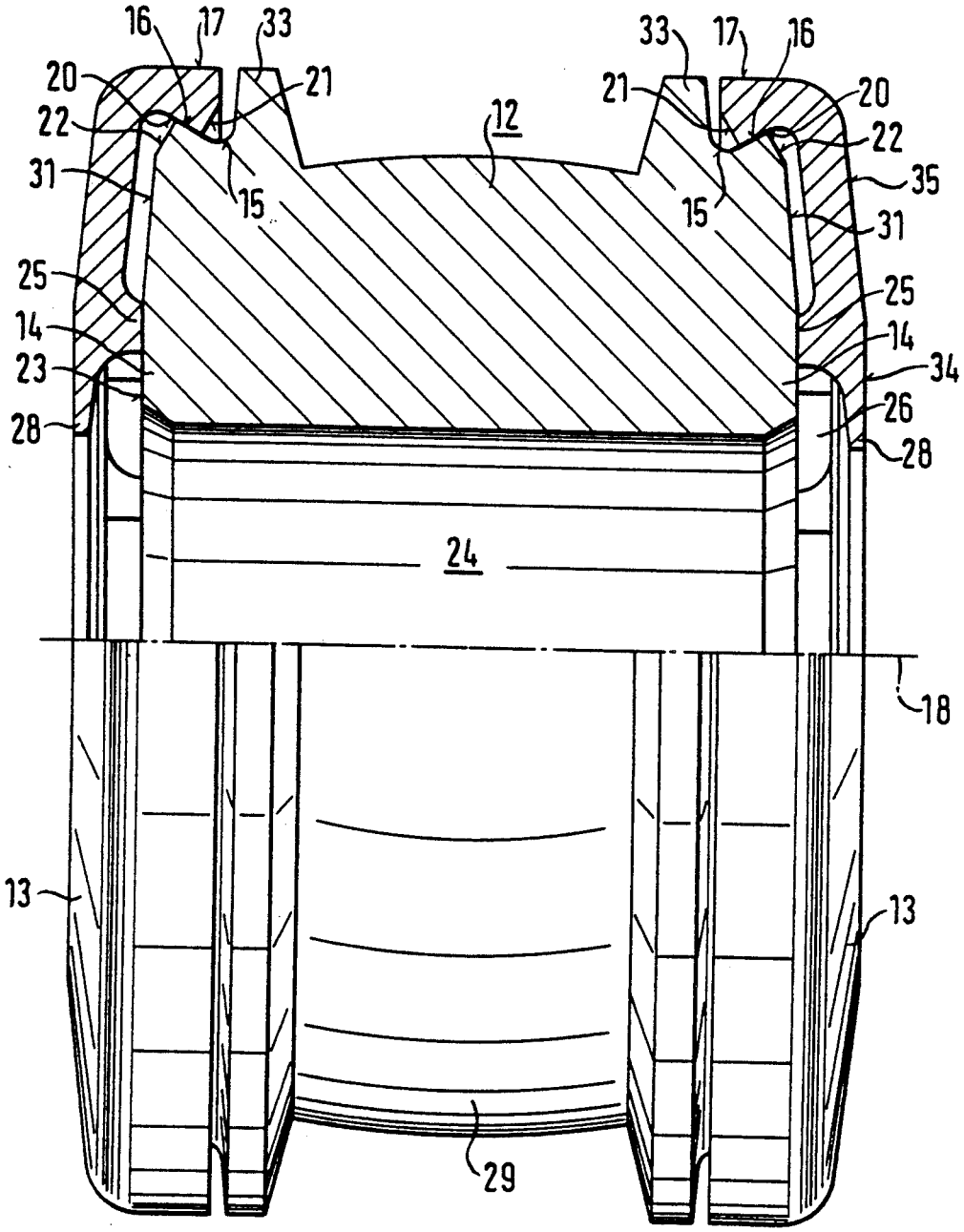
FIG. 3 shows a partial section through the abutment roller of a door fastener according to FIG. 1.

In the embodiments shown in FIGS. 2 and 3, the front sides 23 of the axially directed projections 14 of the rollers are provided with a slightly inclined surface 32 adjoining a surface 31 which is directed vertically relative to the roller axis 18. The caps 13 comprise, at their front sides, surfaces 35 which are arranged so as to be inclined toward the roller circumference adjacent to a central surface which is directed vertically relative to the roller axis 18.

Figure 4:
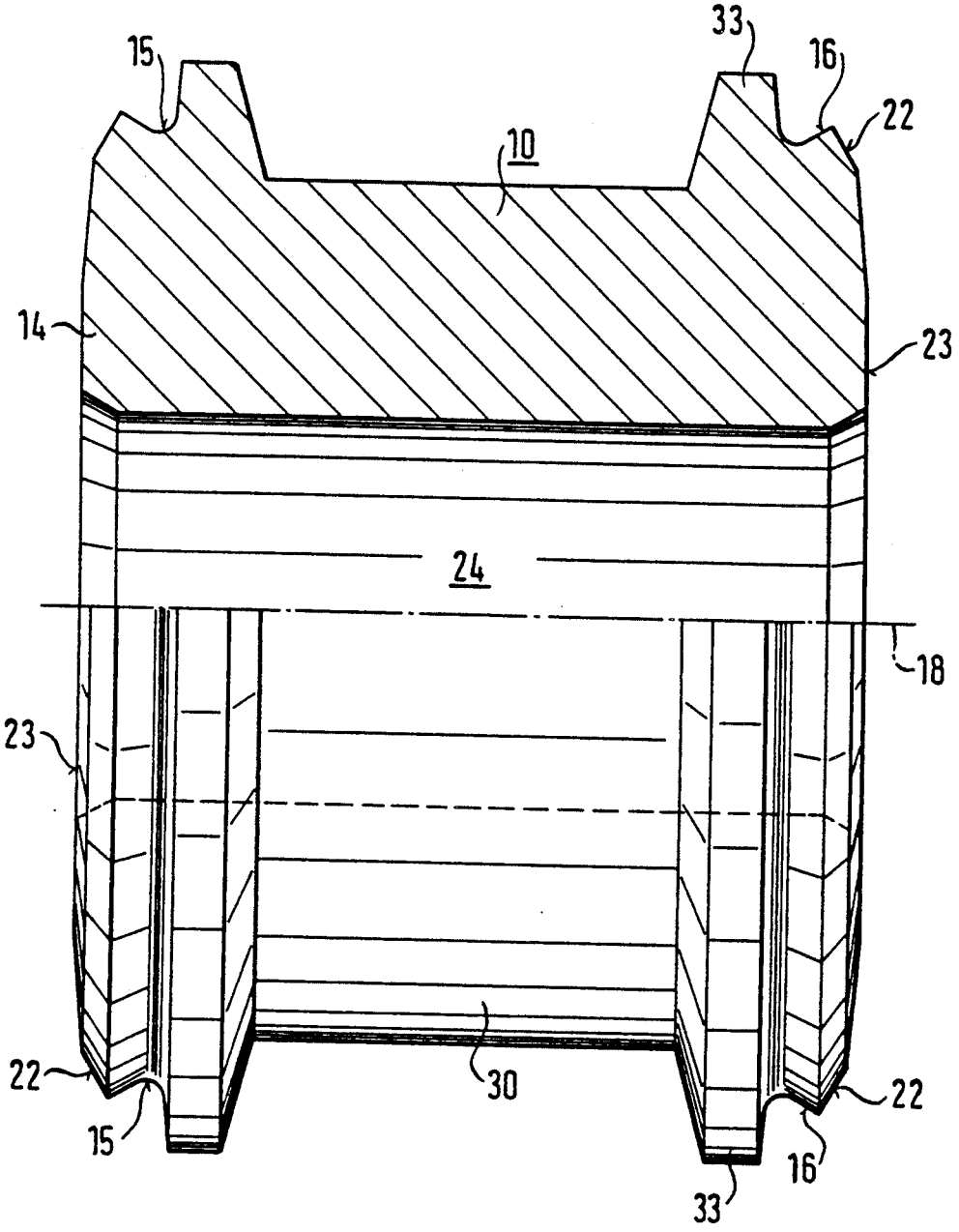
FIG. 4 shows a partial section through another embodiment of the loading roller of a door fastener according to FIG. 1.
Figure 5:
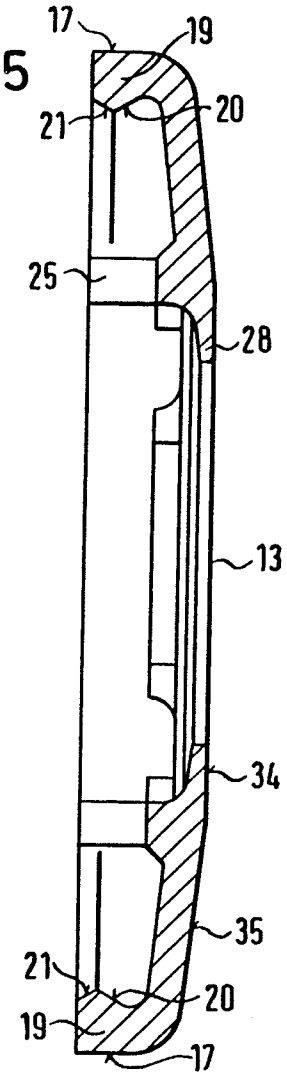
FIG. 5 shows a section through a cap for receiving a lubricant reservoir, which cap is determined for the rollers according to FIGS. 2 to 4.
Figure 6:
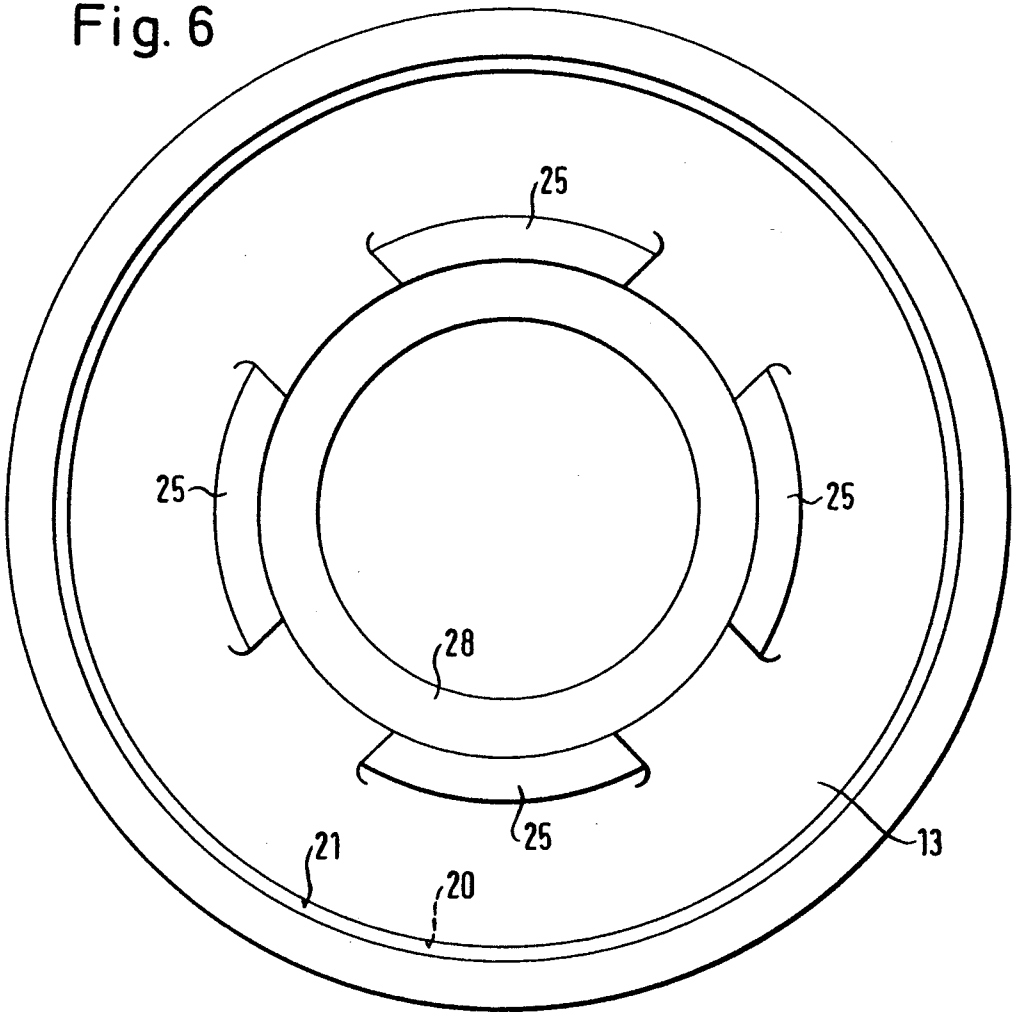
FIG. 6 shows a view from below of the cap according to FIG. 5.

On the other hand, in the embodiment shown in FIG. 4, the end faces 23 of the rollers 10 and 12, respectively, are constructed so as to be smooth and vertical relative to the roller axis 18. Finally, it can be seen in addition from the view in FIG. 2 that the circumferentially extending strips 33 defining the running surface 30 of the loading roller 10 are constructed so as to be high enough that they project over the outer circumferential surface of the circumferential walls 17 of the caps 13.

While the invention has been illustrated and described as embodied in a door fastener for motor vehicle doors, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

1. A door fastener for motor vehicle doors, comprising:

a door holding bar, which is supported at one of a door arrangement part, the door and a door part;

a hold which is fastened at another door arrangement part and is formed from a sheet metal blank which is shaped into a U-shaped housing;

a torsion bar spring supported in said holder via a shaft part and an abutment arm arranged to be abutted by said door holding bar;

an abutment roller supported in said holder so as to be rotatable around a stationary axis;

a loading roller supported on a free loading arm of the torsion bar spring;

the two rollers cooperating with oppositely located narrow sides of said door holding bar formed by means of a flat material blank; and lubricant reservoirs 26 which are sealed relative to outside and assigned to the two rollers and arranged in the area of their two front sides 23 in each instance.

2. A door fastener according to claim 1, wherein the lubricant reservoirs 26 are accommodated by caps 13 which are placed on the front sides of the rollers 10 and 12, respectively, held at a distance relative to their front sides 23 in areas and provided with sealing lips 28.

3. A door fastener according to claim 2, wherein the sealing lips 28 of the caps 13 contact the bearing axis of the rollers 10 and 12, respectively.

4. A door fastener according to claim 2, wherein the caps 13 receiving the lubricant reservoirs 26 are substantially pot-shaped and are held at the rollers 10 and 12, respectively, by a clamping fastening means at their front sides 23.

5. A door fastener according to claim 2, wherein the caps have circumferential walls 17 with an inner circumferential area, circumferentially extending edge beads 19 directed toward the middle of the roller are provided at the inner circumferential area of the circumferential walls 17 of the caps 13, corresponding circumferentially extending receiving grooves 15, which have an asymmetrically V-shaped cross section, are assigned to edge beads 19 at axial projections 14 of the rollers 10 and 12, respectively, the edge beads 19 of the caps 13 and the receiving grooves 15 comprising support shoulders 16 and 20, respectively, which are inclined from outside to inside in each instance and incline downward toward the center of the roller.

6. A door fastener according to claim 5, wherein the caps 13 are supported by support webs 25 at the faces 23 of the axial projections 14 of the rollers 10 and 12, the support webs 25 being directed coaxially relative to the roller axis 18 and arranged at a distance from the edge beads 19 as well as from a bearing bore hole 24 of the rollers 10 and 12.

7. A door fastener according to claim 6, wherein the support webs 25 are arranged at a distance 27 relative to one another in the circumferential direction of the rollers and symmetrically relative to one another with reference to the roller axis 18, the sealing lips 28 being provided so as to contact the respective bearing axis and being cantilevered from the support webs 25.

8. A door fastener according to claim 2, wherein the caps 13 comprise a plastics material and are clipped on the rollers 10, 12.

9. A door fastener according to claim 5, wherein the edge beads 19 of the caps 13 are provided with sliding surfaces 21 which are arranged asymmetrically at acute angles relative to the support shoulders 20, the support shoulder surfaces 20 having an angle of inclination relative to the vertical line greater than the angle of inclination of the sliding surfaces.

10. A door fastener according to claim 9, wherein the angle of inclination of the support shoulders 20 is 60°, the angle of inclination of the sliding surfaces 21 being 30°.

11. A door fastener according to claim 9, wherein the end faces 23 of the axial projections 14 of the rollers 10, 12, in an area adjacent to the receiving grooves 15, are equipped with a diagonal surface 16 directed in the same direction as the sliding surfaces 21 of the edge beads 19 of the caps 13, the diagonal surface 16 having an inclination relative to the vertical line of the same magnitude as the inclination of the sliding surfaces 21 of the edge beads 19 of the caps 13.

12. A door fastener according to claim 6, wherein the caps 13 have front sides 34 which form diagonal surfaces 35 which ascend on their outside toward the roller axis 18, the diagonal surfaces 35 having a slope approximately equal to the height of the support webs 25.

13. A door fastener according to claim 1, wherein the loading roller 10 assigned to the door holding bar 2 has a running surface 29 curved in a barrel-shaped manner.

14. A door fastener according to claim 2, wherein the two rollers 10, 12 each have a running surface 29, 30 and radially directed guide rings 33 at both sides of the running surface 29, 30 assigned to the door holding bar 2, at least one of the guide rings 33 of at least the abutment roller 12 having a height slightly greater than the outer circumference of the caps 13.

* * * * *